US008499526B2

(12) United States Patent
Klersy

(10) Patent No.: US 8,499,526 B2
(45) Date of Patent: Aug. 6, 2013

(54) METHOD OF PRODUCING A HEAVY MODULAR UNIT AND A MODULAR UNIT PRODUCED ACCORDING TO THE METHOD

(76) Inventor: Hans-Berth Klersy, Wiesbaden (DE)

( * ) Notice: Subject to any disclaimer, the term of this patent is extended or adjusted under 35 U.S.C. 154(b) by 24 days.

(21) Appl. No.: 12/451,200

(22) PCT Filed: Apr. 30, 2008

(86) PCT No.: PCT/IB2008/001073

§ 371 (c)(1),
(2), (4) Date: Oct. 30, 2009

(87) PCT Pub. No.: WO2008/135832

PCT Pub. Date: Nov. 13, 2008

(65) Prior Publication Data

US 2010/0088975 A1 Apr. 15, 2010

(30) Foreign Application Priority Data

May 3, 2007 (SE) ..... 0701079

(51) Int. Cl.
*E04B 1/04* (2006.01)
*E04B 1/38* (2006.01)

(52) U.S. Cl.
USPC ..... 52/742.14; 52/742.13; 52/79.5; 52/79.1; 52/251

(58) Field of Classification Search
USPC ..... 52/742.14, 742.13, 742.1, 236.8, 52/236.5, 236.7, 251, 415, 426, 427, 431, 52/79.11, 79.14, 126.5, 125.5, 169.9, 169.13
See application file for complete search history.

(56) References Cited

U.S. PATENT DOCUMENTS

| | | | | |
|---|---|---|---|---|
| 3,750,366 | A | 8/1973 | Rich, Jr. et al. | |
| 3,835,608 | A * | 9/1974 | Johnson | 52/426 |
| 4,185,423 | A | 1/1980 | Gutierrez | |
| 4,338,759 | A * | 7/1982 | Swerdlow et al. | 52/742.14 |

(Continued)

FOREIGN PATENT DOCUMENTS

| | | | |
|---|---|---|---|
| DE | 3512264 | A1 * | 10/1985 |
| FR | 2571770 | A1 * | 4/1986 |
| SE | 8203312 | | 11/1983 |
| WO | WO 2004/090249 | | 10/2004 |

OTHER PUBLICATIONS

International Search Report for PCT/IB2008/001073, mailed Oct. 7, 2008.

(Continued)

*Primary Examiner* — Phi A
(74) *Attorney, Agent, or Firm* — Nixon & Vanderhye PC

(57) ABSTRACT

The present invention encompasses a method, on a building site, of forming a stable and, in terms of weight, heavy modular unit under the utilization of prefabricated, in terms of weight considerably lighter, modular unit (12) transported to the building site, where said heavy modular unit (12*a*) can be adapted to serve as a complete modular-built cellar unit. Said modular unit displays a base slab (14) and double-walled wall sections (10, 11) anchored to the base slab. Inner and outer wall portions (10, 11) are mutually coordinated and secured to one another via supports (18) oriented within a free space formed and structured between the wall portions. The free space is completely filled with a concrete mass, which is caused to cure or set, in order in such instance to form the in terms of weight heavy modular unit. The present invention also discloses a heavy modular unit thus produced.

12 Claims, 1 Drawing Sheet

(56) References Cited

U.S. PATENT DOCUMENTS

Figure 1:
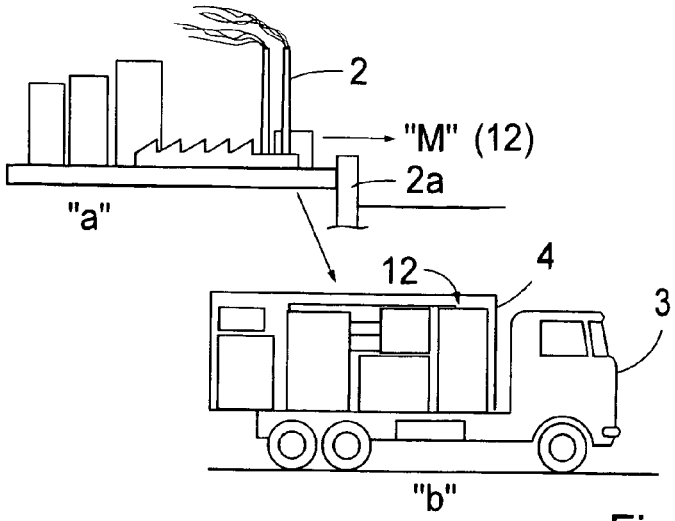

| | | | | | |
|---|---|---|---|---|---|
| 4,532,745 | A | * | 8/1985 | Kinard | 52/251 |
| 4,551,961 | A | * | 11/1985 | Kiselewski | 52/742.14 |
| 4,604,843 | A | * | 8/1986 | Ott et al. | 52/426 |
| 4,669,240 | A | * | 6/1987 | Amormino | 52/236.6 |
| 4,832,308 | A | * | 5/1989 | Slonimsky et al. | 249/78 |
| 4,918,897 | A | * | 4/1990 | Luedtke | 52/742.14 |
| 4,924,641 | A | * | 5/1990 | Gibbar, Jr. | 52/204.1 |
| 4,998,393 | A | * | 3/1991 | Baena | 52/236.9 |
| 5,038,541 | A | * | 8/1991 | Gibbar, Jr. | 52/295 |
| 5,040,344 | A | * | 8/1991 | Durand | 52/127.2 |
| 5,488,806 | A | * | 2/1996 | Melnick et al. | 52/425 |
| 5,819,489 | A | | 10/1998 | McKinney | |
| 5,839,243 | A | * | 11/1998 | Martin | 52/439 |
| 6,041,561 | A | * | 3/2000 | LeBlang | 52/234 |
| 6,085,476 | A | * | 7/2000 | Jantzi et al. | 52/223.7 |
| 6,145,257 | A | * | 11/2000 | Cappuccio | 52/220.2 |
| 6,401,417 | B1 | * | 6/2002 | Leblang | 52/481.1 |
| 6,622,452 | B2 | * | 9/2003 | Alvaro | 52/742.14 |
| 7,254,925 | B2 | * | 8/2007 | Stefanutti et al. | 52/309.9 |
| 7,409,800 | B2 | * | 8/2008 | Budge | 52/241 |
| 7,805,908 | B2 | * | 10/2010 | Rutledge | 52/742.14 |
| 7,900,410 | B2 | * | 3/2011 | Skendzic et al. | 52/251 |
| 2002/0178676 | A1 | * | 12/2002 | Yost et al. | 52/426 |
| 2007/0044392 | A1 | * | 3/2007 | LeBlang | 52/79.11 |

OTHER PUBLICATIONS

Corrected International Search Report for PCT/IB2008/001073, mailed Oct. 7, 2008.

Written Opinion of the International Searching Authority for PCT/IB2008/001073, mailed Oct. 7, 2008.

* cited by examiner

METHOD OF PRODUCING A HEAVY MODULAR UNIT AND A MODULAR UNIT PRODUCED ACCORDING TO THE METHOD

This application is the U.S. National Phase, under 35 U.S.C. §371, of International Application No. PCT/IB2008/001073, filed 30 Apr. 2008, which claims priority to Swedish Application No. 0701079.6, filed 3 May 2007, the entire contents of each of which are hereby incorporated herein by reference.

TECHNICAL FIELD

The present invention relates in general to a method, at a building site or building worksite, of forming in situ a stable and in terms of weight heavy modular unit or units under the utilisation of a prefabricated and in terms of weight considerably lighter modular unit or units produced as a semi-manufacture and transported to the building site.

Said lighter prefabricated modular unit produced as an industrial semi-manufacture is to be transported to said building site and lifted in position and also supplemented in order by simple means to be able to create a complete and in terms of weight heavy modular unit on this building site.

Such a modular unit may then be adapted to be able to serve as a complete modular construction cellar unit.

The present invention is based on the feature of industrially producing a modular unit serving as a semi-manufacture and where the degree of refinement is to be able to be driven as far as possible.

The present invention further builds on the feature that the desired degree of refinement for said lighter modular unit is in any event to be driven so far that the modular unit, on leaving the production line, displays a base slab or a fundament slab and with double-walled wall sections anchored to the base slab, with a number of coordinated inner wall portions facing in towards the modular unit and a number of coordinated outer wall portions facing from the modular unit.

Said inner and outer wall portions are then mutually to be so coordinated and secured to one another via supports oriented within a support formed and freely structured between the wall portions.

In addition, the present invention encompasses a complete heavy modular unit, produced according to the principles of the invention, adaptable int. al. as a cellar module with installed facility details, such as washing room, sauna installation, or as storeys with installed facility details.

BACKGROUND ART

Methods, arrangements and constructions related to the above disclosed technical field and nature are previously known in a plurality of different embodiments.

As a first example of the state of the art and the technical field to which the invention relates mention might be made of various efforts, in order as far as possible to prefabricate units and modules industrially and in a factory plant and which, in the form of whole manufactures or semi-manufactures, can be delivered and transported to a building site in order there to be installed in a house body and connected to existing electricity, water and/or ventilation installations.

It is also previously known in the art, in different respects, to displace the production process to an industrial production in order in such instance to be able to an extensive degree to reduce assembly and installation time at the building site.

Rationalisation gains made in such instance are constantly under review and in any event for details which are smaller in terms of volume it is a rule to strive for rationalisation of production, rendering logistics more efficient and/or adapting production speed directly to a set requirement.

The present invention has for its object in the same spirit to be able to offer a practical application in property and house production, with the aid of transportable prefabricated modular units and where the assembly time has been considerably shortened.

Within this technical field it is known to prefabricate more or less complete wall portions, kitchen units, bathroom units, sauna units, stairwells etc. and position these resting on a base slab and with interior decoration details secured to module-allocated wall portions.

There has also been proposed manufacture of such complete units that requisite connections can be put into effect with simple couplings.

The larger the utilised modules are the heavier they will become and the more difficult becomes their transport which then as far as is possible must be put into effect using cargo vessels.

As regards to the process or the method associated with the present invention, this is based on large and voluminous building constructions and discloses as its point of departure a method of forming at a building site a stable and in terms of weight heavy complete modular unit under the utilisation of a modular unit, which is in terms of weight considerably lighter and is prefabricated and transported to the building site and where said heavy modular unit can be adapted to serve as a complete module-constructed cellar unit and/or mutually stackable light modular units, according as subjacent modular units are converted to heavy and stable modular units.

Via prefabrication, said lighter modular unit is to display a base slab and double-walled wall sections anchored to the base slab, with a number of inner wall portions facing in towards the modular unit and a number of outer wall portions facing from the modular unit, said inner and outer wall portions being mutually coordinated and secured to one another via one or more, for instance parallel oriented vertical supports oriented within a free space formed and structured between the wall portions.

Considering the content of the present invention the following Patent Publications are to be mentioned as a part of the prior art technique.

Thus the Patent Publication U.S. Pat. No. 4,185,423-A discloses a design, fabrication and erection of a lightweight building module in the form of a ribbed concrete floor slab with lightweight thin concrete wall panels and ceiling panel reinforced by a series of spaced rigid annular open web frames.

In this application each frame includes a floor reinforcing member, two side walls reinforcing members, and a ceiling reinforcing member, rigidly welded together at their adjacent ends.

It is here suggested that each reinforcing member is an open web joist having two parallel straight rods spaced apart by an open web member, formed by bending a rod in a zig-zag pattern.

Longitudinal spacing of adjacent bend is greater in the central portion than the ends of the reinforcing members.

A poured concrete roof slab is formed with integral reinforcing ribs by means of rectangular spacer made of light weight material.

The modules may be installed at a building site by distributing a layer of thin mortal over compacted earth and placing each module thereon before the mortal hardens so that the weight of the module is evenly distributed by the mortal pad.

A cross-bracing feature for multiple story buildings improves the strength, rigidity and stability of the total structure.

FIG. 19 in this publication does disclose the erection of a building module.

A floor element (152) wall panels (153, 154) and ceiling panels (155) are coordinated to form a rectangular module unit.

It is here suggested the use of attachment and securing means. The final cooperation is here caused by a welding process.

The Swedish Patent Application Publication SE-82 03312-A discloses a building structure exposing wall sections, consisting essentially of concrete material or the like, where said wall sections are moulded at the building site by using prefabricated formed wall elements (10).

These are forming parts of the building and are intended to form outer and inner wall sections.

The height of said wall element (10) is given the same height as the height of the flat.

Some of the wall elements are formed with windows (11) and/or doors and also ducts for electrical conductors and tubes for water supply.

It is here suggested that during the erection of the building a first wall element, with its reinforcement rods, is moulded together with an adjacent wall section or element and the reinforcement rods may than extend into an adjacent wall element or section.

Patent Publication U.S. Pat. No. 5,819,489-A discloses a pre-formed building studs and a form utilizing such studs for receiving a flowable, hardenable material, for example cementitious material including concrete, for forming building structures such as foundations, walls, floors, roofs etc.

The studs allow passage of the cementitious material therethrough when poured into the form.

The form comprises a hollow wall that includes two opposing form panels connected to preformed, flow-through studs, forming fluidly connected sections between each stud.

As the cementitious material fills the hollow wall, each section is fluidly joined, allowing the cementitious material to harden and cure to form an integrated solid wall.

Each stud includes two elongated parallel members having a flow-through web structure extending between the elongated members.

By selecting from panels that are thermal insulators and waterproof, the resulting structure has improved moisture resistance and thermal insulation properties, both during and after the curing process.

The Patent Publication U.S. Pat. No. 3,750,366-A discloses a building employing prefabricated room-enclosing modules, which function also as a box-shaped horizontal beams and ties for connecting vertical weight-supporting columns into a rigid framework.

The columns are preferably concrete members, which are poured in place into spaces formed between the modules.

The inter-module spaces include vertical chases and horizontal plenums which are in communication with each other and with a heating/cooling plant output, to form an air jacket which surrounds each module over a plurality of its exterior surfaces, and operates as a effective radiant heat exchanger therewith.

The heated or cooled air is ultimately discharged into the interior occupancy apace of the modules so as to provide a combination radiant and convective heating/cooling system.

BRIEF SUMMARY OF THE PRESENT INVENTION

Technical Problem

Taking into account the circumstance that the technical considerations which a person skilled in the art must do in order to be able to offer a solution to one or more set technical problems is on the one hand initially a necessary insight into the measures and/or the sequence of measures to be implemented and on the other hand a necessary selection of the means required, in view hereof the following technical problems are therefore likely to be relevant in the evolution of the subject matter of the present invention.

Taking into account the state of the art as described above, it is probably likely therefore to be seen as a technical problem to be able to realise the importance of, the advantages associated with and/or the technical measures and considerations which will be required in order to simplify and reduce the otherwise lengthy assembly time at a building site by disclosing a method, at the building site, of forming a stable and in terms of weight heavy modular unit, under the utilisation of a prefabricated modular unit in terms of weight considerably lighter and transported to the building site, where said heavy modular unit can be adapted to serve as a complete modular-constructed cellar unit and dimensioned with its wall portions so that it can withstand prevailing geostatic pressure.

The method is based on the feature, in said prefabricated lighter modular unit, of causing the unit to display a base slab, and with double-walled wall sections or coordinated wall elements anchored to the base slab, with a number of inner wall portions facing in towards the modular unit and a number of outer wall portions, facing from the modular unit, said inner and outer wall portions being mutually coordinated and fixed to one another via supports oriented in a free space formed and structured between the wall portions and where the wall portions can be structured as rigid concrete-like slabs.

There resides a technical problem in being able to realise the importance of, the advantages associated with and/or the technical measures and considerations which will be required in order to the free empty space, defined by said inner wall portions, with such dimensions and mechanical strength related properties that these wall portions and/or with the help of support on the one hand can support selected modular unit-allocated interior design details, secured to selected wall sections, allocated to the inner wall portion, on the other hand form a first form side and thereby be able to withstand the pressure forces occurring in vibration-free concrete pouring, and from said outer wall portions, with such dimensions and mechanical strength related properties that these wall portions and/or with the aid of support can form a second opposing form side and thereby be able to withstand the pressure forces occurring in a vibration-free concrete pouring, fill this free space wholly with a viscous concrete mass, which is allowed to harden, to cure or set in order in such instance to form the in terms of weight heavy modular unit.

There resides a technical problem in being able to realise the importance of, the advantages associated with and/or the technical measures and considerations which will be required in order to utilise said free space for the requisite plumbing or channel laying such as for electric lines, for water supply, for air ventilation and the like.

There resides a technical problem in being able to realise the importance of, the advantages associated with and/or the technical measures and considerations which will be required in order to cause the inner wall portion to be formed from a panel-structured fire resistant material, such as one or more panels displaying a selected thickness, and/or cause the outer wall portion to be formed from a panel-structured fire resistant material, such as one or more panels, displaying a selected thickness.

There resides a technical problem in being able to realise the importance of, the advantages associated with and/or the technical measures and considerations which will be required in order to cause each or selected requisite plumbing or channel laying to be mounted and secure against suitable support, before the inner wall portion is secured to said support.

There resides a technical problem in being able to realise the importance of, the advantages associated with and/or the technical measures and considerations which will be required in order, as said viscous concrete mass, to utilise a concrete mass admixed with fibers or reinforced.

There resides a technical problem in being able to realise the importance of, the advantages associated with and/or the technical measures and considerations which will be required in order as said viscous concrete mass to utilise a steel fiber reinforced, a carbon fiber reinforced and/or another fibrous concrete mass.

There resides a technical problem in being able to realise the importance of, the advantages associated with and/or the technical measures and considerations which will be required in order to cause said support to be formed as vertical beams, as "I"-beams and/or "H"-beams or the like, and with recesses formed within the webs of the beams in order thereby to create a continuous concrete structure through said recesses.

Solution

In such instance, the present invention takes as its point of departure the prior art as disclosed by way of introduction regarding a method, at a building site, of forming a stable and in terms of weight heavy modular unit or units under the utilisation of a in terms of weight considerably lighter modular unit prefabricated and transported to the building site, where said heavy modular unit can be adapted to serve as a complete modular-built cellar unit, said lighter modular unit displaying a base slab, and with double-walled wall sections anchored and/or secured to the base slab, with a number of inner wall portions facing in towards the modular unit and a number of outer wall portions, facing away from the modular unit, said inner and outer wall portions being mutually coordinated and fixed to one another via supports, oriented within a space, freely structured and formed between the wall portions.

In order to be able to solve one or more of the above disclosed technical problems, the present invention more specially discloses that the prior art technique is to be supplemented by disclosing and utilising equal or unequal dimension studding, valid for an inner and an outer wall section.

More specially, the present invention is based on the insight and discloses more specially, that the free space, defined inwardly by said inner wall portions, is to display such dimensions and mechanical strength-related properties that these wall portions and/or with the aid of support on the one hand can support selected modular unit-allocated interior design details, fixed to selected wall sections, allocated to the inner wall portion, on the other hand form a first form side and thereby be dimensioned in order to be able to withstand the inwardly directed pressure forces occurring in concrete pouring, and that said outer wall portions, are to display such dimensions and mechanical strength-related properties that these wall portions and/or with the help of supports can form a second opposing pouring form side and thereby be dimensioned in order to be able to withstand the outwardly directed pressure forces occurring on concrete pouring, shall wholly or partly be filled with a viscous concrete mass supplied from above, such as a concrete mass without requirements of vibration, which is to set or cure in order in such instance to form the in terms of weight heavy and complete modular unit.

As proposed embodiments, falling within the scope of the basic idea of the method disclosed for the present invention, it is in addition disclosed to utilise said free space for requisite conduit or channel laying, such as for electric lines, for water supply, for air ventilation etc.

The inner wall portion should be formed from a panel-structured fire resistant material, such as one or more fire reinforced panels with a selected thickness while the outer wall portion shall be formed from a panel-structured fire resistant material, such as one or more fiber reinforced panels, normally with a thickness of between 12 and 30 mm, for instance 22 mm.

Requisite conduit or channel laying shall also be mounted in and fixed against suitable supports, before the inner wall portion is fixed to said support, in order to form and surround said free space, As said viscous concrete mass use is made principally of a fiber reinforced concrete mass, such as a steel fiber reinforced concrete mass.

Said support can then be formed as vertical beams, and with recesses within the webs of the beams, in order thereby to create a continuous concrete structure through said recesses.

Advantages

Those advantages which may principally be deemed to be characteristic of the present invention and the special significative characterising features disclosed thereby are that there have hereby been created the preconditions in order via an industrial production to be able to produce a semi-manufacture, bordering on a whole manufacture, transport this to a building site and thereafter fill empty wall portions with a viscous fiber reinforced concrete mass in order thereby to form a complete heavy modular unit even adapted to be able to serve as a cellar unit, where the wall portions are dimensioned in order to withstand expected geostatic pressure by a dimensioning of the wall thickness.

That which principally be deemed to be characteristic of the present invention is disclosed in the characterising clause of appended claim 1.

BRIEF DESCRIPTION OF THE ACCOMPANYING DRAWINGS

Figure 2:
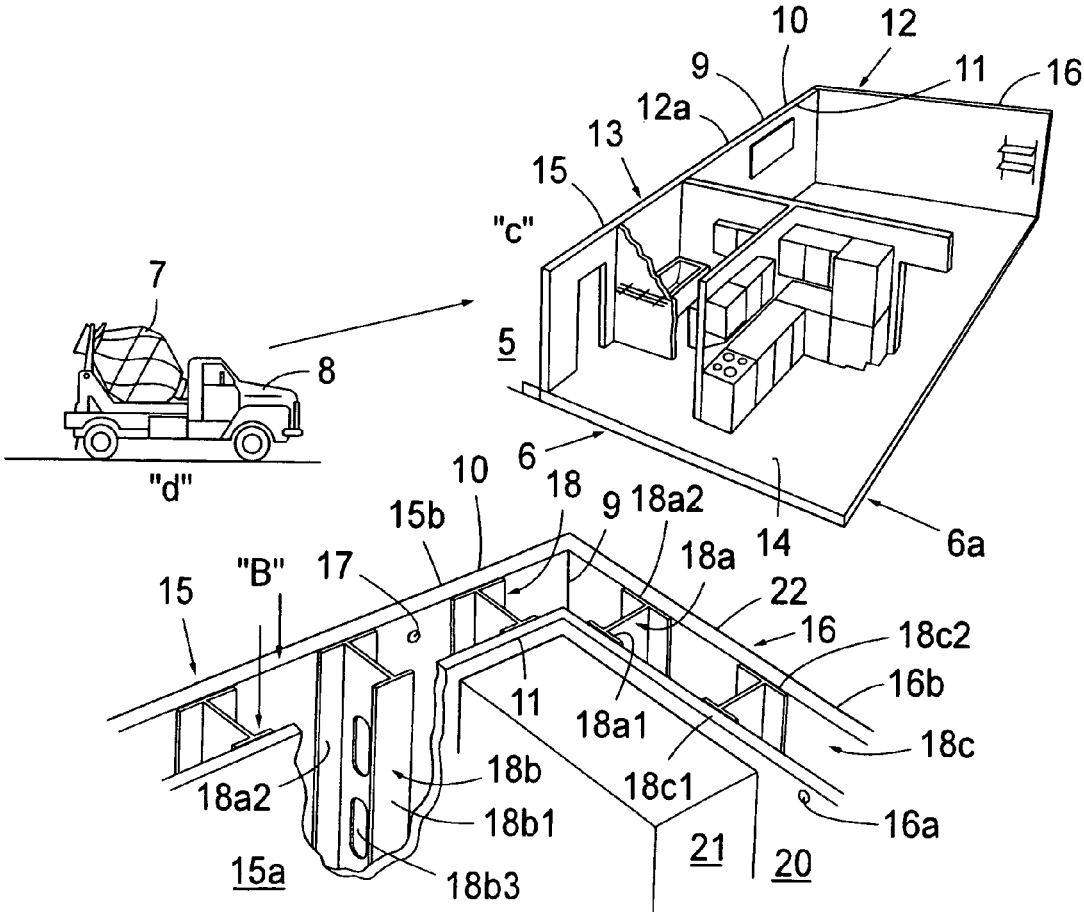

One currently proposed embodiment, displaying the significative characterising features associated with the present invention, will now be described in greater detail hereinbelow, with reference to the accompanying Drawings, where;

FIG. 1 shows in four different sequences the presence of:

a. a production site for an industrial production of "light" modular units, each one considered as a semi-manufacture (even if extremely limited further measures are required to form a "heavy" modular unit), b. a transport of these light modular units via cargo vessel and/or cargo vehicle to a building site, c. a positioning of this light modular unit on an indicated, prepared and pre-treated surface area, at a selected part of the building site and d. a transport of viscous and with delay diluted concrete to the building site, in order there to be able to form, by a supplied concrete volume to the free space structured between outer and inner walls for the light modular unit, a weight increase to a heavy modular unit and FIG. 2 schematically shows in perspective view a magnified corner portion of the light modular unit, according to FIG. 1, and where it is illustrated the openings to supply of concrete mass.

DESCRIPTION OF CURRENTLY PROPOSED EMBODIMENT

By way of introduction it should be emphasised that in the following description of one currently proposed embodiment, which displays the significative characterising features associated with the present invention and which has been clarified by the figures illustrated in the accompanying Drawings, we have selected terms and a special terminology with the intention in such instance principally of clarifying the inventive idea.

However, in this context it should be taken into consideration that expressions selected here should not be seen as restrictive exclusively to the terms utilised here and selected but it should be understood that every such selected term is to be interpreted so that it in addition encompasses all technical equivalents which function in the same or substantially the same manner, in order in such instance to be able to attain the same or substantially the same intention and/or technical effect.

With reference to accompanying FIGS. 1 and 2 there are thus illustrated schematically and in detail the basic preconditions for the method associated with the present invention and where the significative properties associated with the invention have been given concrete form by means of the now proposed and hereinafter more closely described embodiment.

The FIG. 1 is intended to illustrate the different steps which the method disclosed by the invention requires, but it will clearly be apparent also from this description the form and construction of the included details in a "light" modular unit and, by a selected volume of supplied concrete mass, a weight increased or "heavy" modular unit.

Thus FIG. 1 shows, under section "a", schematically a production site 2 for an industrial production of "light" modular units "M", where such a modular unit can be illustrated under illustration section "c".

Each one of the modular units "M" or 12 produced here consider here quite correctly as a semi-manufacture, since, according to the invention, the production process within production site 2 has been driven so far that extremely limited further measures are required in order to form a complete modular unit, hereafter designated 12*a* in section "c".

The here intimated measures are limited to filling a specially formed free space within wall portions.

Under illustration in section "b" it is illustrated how such a light modular unit 12, as a semi-manufacture. is transported by a well adapted and dimensioned load vehicle 3, with a load space 4, to a building site 5.

This transport can advantageously take place via cargo vessel, since the production site 2 is to be placed adjacent a quay installation.

When the cargo vehicle 3 has arrived at the building site 5 the module 12 is lifted from the cargo space 4 by a separate crane arrangement, not shown in the figures, and allows lowering of the modular unit 12 to a selected surface area 6.

The placing of this light modular unit 12 takes place against the surface region 6 and more specially to an indicated, pretreated and prepared surface part area 6*a* of a building site.

Under illustration in section "d" it is illustrated a transport of concrete 7 by a load vehicle 8 to the building site 5, in order there to be able to form, by a supplied concrete volume to the free space 9, structured between outer 10 and inner walls 11 for the light modular unit 12, a weight increase and stabilisation of this light modular unit 12 to a heavy modular unit 12*a*.

More specially the present invention relates to a method, at a building site 5, for forming a stable and in terms of weight heavy modular unit 12*a*, under the utilisation of a prefabricated in terms of weight considerably lighter modular unit 12 transported to the building site 5, where said heavy modular unit 12*a* can be adapted to serve as a complete modular built cellar unit 13.

In this application the wall portions 10 and 11 are to offer a wall thickness, which can withstand an expected geostatic pressure.

Said lighter modular unit 12 displays a base slab 14 and double-walled wall sections 15, 16 anchored to the base slab, with a number of inner wall portions 15*a*, 16*a* facing in towards the modular unit and a number of outer wall portions 15*b*, 16*b* facing from the modular unit, said inner and outer wall portions being mutually coordinated and fixed to one another via supports 18, 18*a* and 18*b*, oriented within a free space 17 formed and structured between the wall portions.

More specially it is disclosed that said supports 18. 18*a*, 18*b* are each one to display a "H"-shaped or "I"-shaped beam, in cross section, with opposing parallel shanks facing towards and fixing to the wall portions 15*a*, 15*b*, 16*a*, 16*b*, respectively.

According to the fundamental principles of the invention, the inner walls 15*a*, 16*a* and the outer walls 15*b* and 16*b* are to be rigid enough to be able to withstand the inner pressure which the supplied viscous concrete mass "B" exercises without vibration.

To this end it is disclosed that the inner walls 15*a*, 16*a* on the inside are to be rigidified with the aid of fixedly mounted interior design details, such as a first detail in the form of a cabinet 21, which are advantageously to be secured to rearward supports 18, 18*a*, 18*c* with an interjacent panel material 20, here illustrated as a concrete-related panel, for instance with a thickness of between 12 and 30 mm, for instance 22-27 mm.

FIG. 2 intends then to illustrate how the interior design detail 21 is to be fixed to the shank 18*a*1 and the shank 18*c*1, but also to the support 18 allocated to the shank in order to be able to contribute to the stability of the wall.

It should then be noted that the outside, in this embodiment, cannot offer such a support, for which reason the dimensioning of the outer wall 15*b*, 16*b* is based on the application of outer panel material 22, here illustrated as a concrete-related panel, with a thickness of between 12 and 30 mm, for instance 22-27 mm.

It is specially apparent from FIG. 2 that if the supports 18, 18*a*, 18*b*, 18*c* are oriented at a standardised distance between one another of 600 mm, the shanks 18*a*2, 18*c*2 are given an adapted width, say of the order of magnitude of 100 to 200 mm, and with the panels fixed along the vertical edge regions of the shanks, in order thereby to be able to reduce the free span of the interjacent panel section, at reference numeral 22.

In addition, the present invention discloses that each support 18, 18*a*, 18*b* and 18*c* is to be provided with throughgoing recesses, such as the recess 18*b*3 formed in the web of the support 18*b* and centrally related between the shanks 18*b*1, 18*b*2 of the support 18*b* in order thereby to permit a viscous and with time lag for the setting time diluted concrete mass "B" to flow out and interconnect the empty sections of the wall portions.

The concrete mass "B" is to consist of a fiber reinforced concrete mass. In such instance, it is proposed by way of example the use of steel fiber reinforced, glass fiber reinforced, carbon fiber reinforced and prefabricated concrete mass.

It should here be noted that the panel material 15, 16 and/or 11, 12 is to consist of a flexurally rigid material, such as cement fiber panels, which can interconnect to supplied concrete mass "B".

The invention is naturally not restricted to the embodiment disclosed by way of example above, but may undergo modifications within the scope of the inventive concept illustrated in the appended Claims.

It should specially be noted that every illustrated unit and/or circuit can be combined with every other illustrated unit and/or circuit within the scope in order to be able to attain the desired technical function.

The invention claimed is:

1. A method of forming, at a building site, a stable and, in terms of weight, heavy modular unit that can be adapted to serve as a complete modular-built cellar unit, the method comprising the steps of:

transporting to the building site a prefabricated and, in terms of weight, considerably lighter complete modular unit previously formed at a production site different from the building site, said lighter modular unit including:

a base slab having length and width dimensions corresponding to those of a cellar, a plurality of double-walled wall sections formed from flexurally rigid cement fiber panels and anchored to the base slab, the plurality of double-walled wall sections including a number of inner wall portions facing in towards the modular unit and a number of outer wall portions facing from the modular unit, said inner and outer wall portions being mutually coordinated, a plurality of supports securing said inner and outer wall portions together, the plurality of supports being located within a free space formed between the inner and outer wall portions, and dimensionally defined by said inner and outer wall portions secured to one another via said supports, and one or more modular unit-allocated interior design details mounted within the double-walled wall sections, at the building site, filling the free space with a concrete mass which is caused to cure or set to form, in terms of weight, in combination with the lighter modular unit., the heavy modular unit, the inner wall portions having such dimensions and mechanical strength-related properties that these inner wall portions, in combination with only said supports, support selected ones of the modular unit-allocated interior design details, which are fixed to selected wall sections of the inner wall portions, and form a first form side of said free space that is able to withstand the pressure forces occurring upon concrete pouring into said free space, and said outer wall portions having such dimensions and mechanical strength-related properties that these outer wall portions, in combination with only said supports, form a second opposing form side of said free space that is able to withstand the pressure forces occurring upon concrete pouring into said free space.

2. The method as claimed in claim 1, wherein said free space is used for requisite conduit or channel laying for electric lines, for water supply, and/or for air ventilation.

3. The method as claimed in claim 1, wherein requisite conduit or channel laying is mounted in and secured against suitable supports, before the inner wall portion is secured to said support.

4. The method as claimed in claim 1, wherein for said concrete mass, use is made of a fiber reinforced concrete mass, in the form of a self-compacting structure.

5. The method as claimed in claim 4, wherein for said concrete mass, use is made of a fiber reinforced concrete mass without vibration.

6. The method as claimed in claim 1, wherein said supports are formed as vertical beams, such as "H" or "I" beams, and with recesses within the webs of the beams, to thereby create a continuous concrete structure through said recesses when the free space is filled with a concrete mass.

7. A heavy modular unit adapted to serve as a complete modular-built cellar unit at a building site, said heavy modular unit comprising:

a prefabricated and, in terms of weight, considerably lighter complete modular unit previously formed at a production site different from the building site, said lighter modular unit including:

a base slab having length and width dimensions corresponding to those of a cellar, a plurality of double-walled wall sections formed from flexurally rigid cement fiber panels and anchored to the base slab, the plurality of double-walled wall sections including a number of inner wall portions facing in towards the modular unit and a number of outer wall portions facing from the modular unit, said inner and outer wall portions being mutually coordinated, a plurality of supports securing said inner and outer wall portions together, the plurality of supports oriented within a free space formed between the inner and outer wall portions, and dimensionally defined by said inner and outer wall portions secured to one another via said supports, and one or more modular unit-allocated interior design details mounted within the double-walled wall sections, a concrete mass, which fills the free space at the building site, and which is cured or set to form, in terms of weight, in combination with the lighter modular unit, the heavy modular unit, the inner wall portions having such dimensions and mechanical strength-related properties that these inner wall portions, in combination with only said supports, support selected ones of the modular unit-allocated interior decoration details, which are fixed to selected wall sections allocated to the inner wall portions, and form a first form side of said free space that is able to withstand the pressure forces occurring upon concrete pouring into said free space, and said outer wall portions having such dimensions and mechanical strength-related properties that these outer wall portions, in combination with only said supports form a second opposing form side of said free space that is able to withstand the pressure forces occurring upon concrete pouring into said free space, such that the free space is filled with the concrete mass.

8. The heavy modular unit as claimed in claim 7, wherein located within said free space is requisite conduit or channel laying for electrical lines, for water supply, and/or for air ventilation.

9. The heavy modular unit as claimed in claim 7, wherein the requisite conduit or channel laying is mounted in and secured to suitable supports before the inner wall portion is secured to said support.

10. The heavy modular unit as claimed in claim 7, wherein said concrete mass has the structure of a fiber-reinforced concrete mass, in the form of a self-compacting structure.

11. The heavy modular unit as claimed in claim 10, wherein said concrete mass has the structure of a fiber-reinforced concrete mass without vibration.

12. The heavy modular unit as claimed in claim 7, wherein said supports are formed as vertical beams, such as "H" or "I"beams and with recesses within the webs of the beams, in order thereby to create a continuous concrete structure through said recesses.

* * * * *